United States Patent [19]

Sperling

[11] 4,055,211

[45] Oct. 25, 1977

[54] FABRIC HANGING AND PLEATING BRACKET WITH STABILIZING ELEMENTS

[76] Inventor: Phillip Sperling, 3206 Coolidge Ave., Los Angeles, Calif. 90066

[21] Appl. No.: 693,368

[22] Filed: June 7, 1976

[51] Int. Cl.[2] ..... A47H 23/00; E05D 13/02

[52] U.S. Cl. ..... 160/327; 16/87.2

[58] Field of Search ..... 16/87.2, 86.1, 87 R; 160/327, 348, 382; 248/306

[56] References Cited

U.S. PATENT DOCUMENTS

| | | | |
|---|---|---|---|
| 2,557,578 | 6/1951 | Stallone | 160/348 |
| 3,185,207 | 5/1965 | Humble | 160/327 X |
| 3,313,424 | 4/1967 | Gingher | 16/87.2 X |
| 3,399,712 | 9/1968 | Weisberg | 160/348 |
| 3,683,994 | 8/1972 | Eichenlaub | 160/327 |
| 3,785,426 | 1/1974 | Sperling | 160/327 |

*Primary Examiner*—Werner H. Schroeder
*Assistant Examiner*—Moshe I. Cohen
*Attorney, Agent, or Firm*—John E. Kelly

[57] ABSTRACT

A sectional and adjustable bracket for hanging drapery and other wall covering fabrics has an elongated holding bar that holds removable hanger units. The hanger units are shaped to form fabric pleats and include rearwardly extending shoulders. The holding bar is formed with stabilizing slots sized to receive the shoulders and prevent them from wobbling and moving laterally. The top edge of the holding bar has prongs and the top edges of the hanger units have spikes to pierce the fabric margin and support the fabric in place.

5 Claims, 6 Drawing Figures

FABRIC HANGING AND PLEATING BRACKET WITH STABILIZING ELEMENTS

BACKGROUND OF THE INVENTION

This invention generally relates to fixtures for holding fabric to walls and more specifically relates to an adjustable bracket with separable parts that can be selectively positioned to form and maintain pleats in a wall covering fabric.

For both functional and decorative reasons it is sometimes desirable to face or cover large walls of a theatre, auditorium or other building with pleated fabric instead of conventional wallpaper, paneling, etc.

It is well known to bend a thin strip of metal at equally spaced intervals along its length to constitute pleat-forming bends. When a drapery or other fabric is pressed over the pleat-forming bends and secured in some manner to the strip then the pleats become created to present an attractive covering. The fabric may be attached to a metal holding strip by way of pinching or gripping elements as shown in U.S. Pat. No. 2,242,355 to Harris (1941), by wedges as disclosed in U.S. Pat. No. 631,401 to Kuhnel et al. (1899) or by sharp prongs or projections as shown in U.S. Pat. No. 2,238,891 to Cohen et al (1941), U.S. Pat. No. 2,557,578 to Stallone (1951) and U.S. Pat. No. 3,185,207 to Humble (1965).

These above-mentioned types of fabric hanging brackets have pleat-forming bends fixed in position, making the pleating pattern non-adjustable.

This invention is an improvement over the concept of a sectional and adjustable bracket as disclosed in my U.S. Pat. No. 3,785,426 (1974). The principal aim of this invention is to stabilize, strengthen and prevent wobbling of the overall bracket.

SUMMARY OF THE INVENTION

Briefly stated, this invention is a fabric hanging and pleating bracket with stabilizing elements that can be easily installed and disassembled and is capable of creating a broad variety of pleating patterns.

In its broader aspects the bracket includes an elongated holding bar having a lower strip with a bottom edge, an upper strip with a top edge offset outwardly and forwardly from the lower strip and an intermediate strip that interlinks the lower and upper strips. A plurality of prongs extend upwardly from the top edge of the upper strip for piercing and supporting fabric.

At least one separable hanger unit is removably coupled to and projects forwardly from the holding bar. The hanger unit has a front wall shaped to assist in forming a fabric pleat and a pair of rearwardly extending shoulders. Spikes extend upwardly from the top edge of the hanger unit for piercing and supporting fabric.

Stabilizing means is coupled to the holding bar lower strip and arranged to engage at least one of the hanger unit shoulders to restrain it from wobbling and lateral movement. When the fabric is laid generally against the holding bar and hanger unit and drawn over the prongs and spikes, then a portion of the fabric will be formed into a pleat.

Preferably the stabilizing means is integrally formed with the holding bar lower strip. The stabilizing means, in the preferred embodiment, is a forwardly projecting flange struck out from the holding bar lower strip and is formed with a plurality of parallel gaps defining a plurality of tongues. At least one of the hanger units shoulders is inserted into a gap and restrained from lateral movement by adjacent tongues.

A recess is formed in the holding bar upper strip and is arranged in vertical alignment with the stabilizing means. The hanger unit is formed with a pair of support hooks at least one of which is positioned in the recess. The holding bar intermediate strip is formed with retention slots sized and positioned to receive the support hooks.

The hanger units may be of different configurations and interchangeable with one another in order to achieve a broad variety of pleating patterns.

BRIEF DESCRIPTION OF THE DRAWINGS

The numerous benefits and unique aspects of this invention will be fully understood when the detailed description is studied in conjunction with the drawings in which.

DETAILED DESCRIPTION OF THE PREFERRED EMBODIMENT

Figure 1:
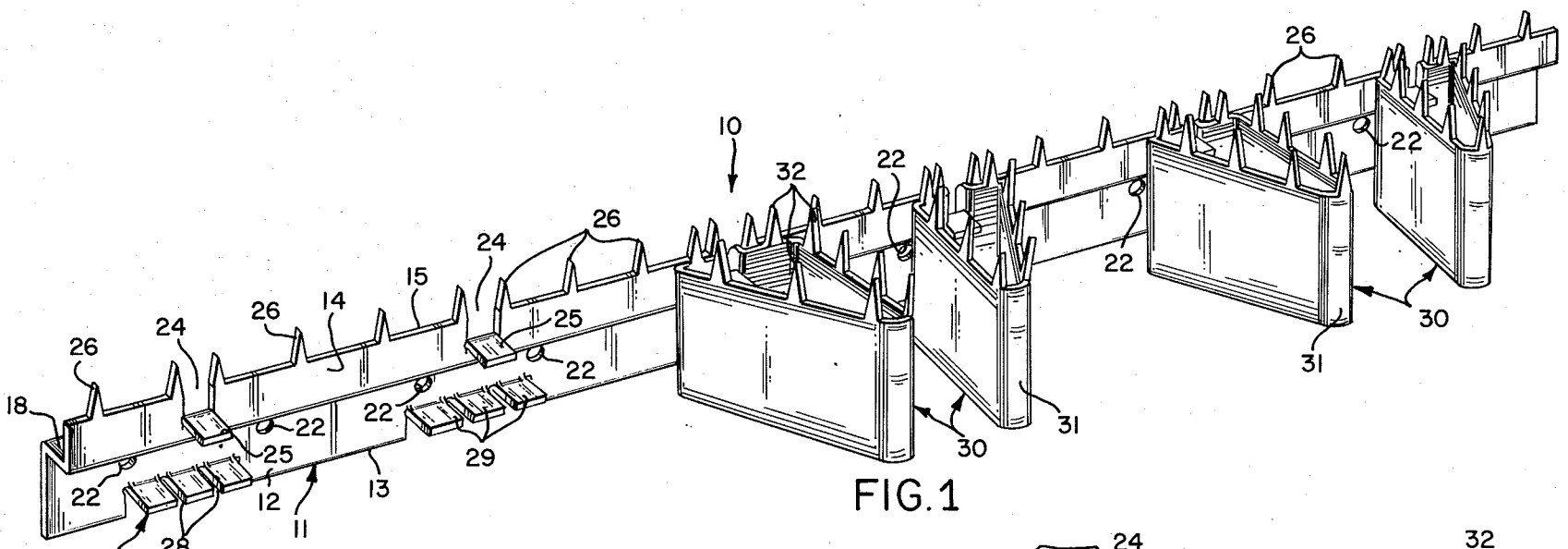
FIG. 1 is a perspective view of a fabric hanging and pleating bracket constructed in accordance with this invention, illustrating a number of hanger units coupled to the holding bar.

Referring now primarily to FIG. 1, a fabric hanging and pleating bracket 10 is shown generally oriented for installation against the wall of a large room such as theatre for example. The bracket 10 includes an elongated holding bar 11 integrally formed from a metal sheet. A number of brackets 10 would normally be arranged in side-by-side relationship to span across a pre-determined wall length. The holding bar 11 has an irregular cross section, shown to be of zig-zag configuration and includes a lower strip 12 with a bottom edge 13. The holding bar has an upper strip 14 with a top edge 15 and an intermediate strip 18 that links the lower strip 12 and the upper strip 14 together. A plurality of fastener holes 22 are formed through lower strip 12 to facilitate the mounting of bracket 10 against a wall.

Formed within the top edge 15 of upper strip 14 is a plurality of longitudinally spaced recesses 24 of general rectangular shape. The recesses 24 are formed by striking out metal sections bent forwardly to constitute tabs 25.

A plurality of prongs 26 are formed on the top edge 15 of upper strip 14 and extend upwardly to eventually assist in piercing and supporting wall fabric.

The lower strip 12 of holding bar 11 is formed with stabilizing means 27. The stabilizing means 27 is a forwardly bent flange struck from lower strip 12 and cut so as to have a plurality of parallel gaps 28 that define a plurality of stabilizing tongues 29.

A group of separable hanger units 30 are shown removably coupled to the holding bar 11 and are aligned to project outwardly and forwardly from the holding bar 11. The hanger units 30 are coupled to the holding bar 11 at selected points or station which may be defined by the recesses 24. The desired pleating pattern may be modified by arranging the hanger units 30 in all of the recesses to constitute a fully pleated pattern, or may be arranged to skip some recesses 24 to create a staggered or irregular pleating design.

Figure 2:
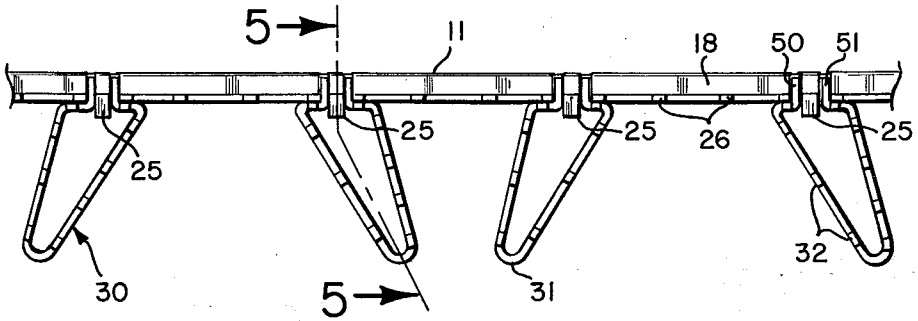
FIG. 2 is a top sectional view of the bracket assembly, showing the hanger units re-arranged relative to their positions shown in FIG. 1.

The particular hanger units 30 chosen for purposes of illustration are arranged in pairs. The particular hanger units 30 of each pair are oblique and generally symmetrical. Their positions may be reversed in order to achieve a different pleating pattern as shown by FIG. 2.

Each hanger unit 30 has a front wall 31 shaped to assist in forming a fabric pleat of a desired configuration and a series of upstanding spikes used to pierce and support the fabric. The spikes 32 and prongs 26 coact to hold wall covering fabric in a predetermined position in order to achieve a desired pleating effect.

Figure 3:
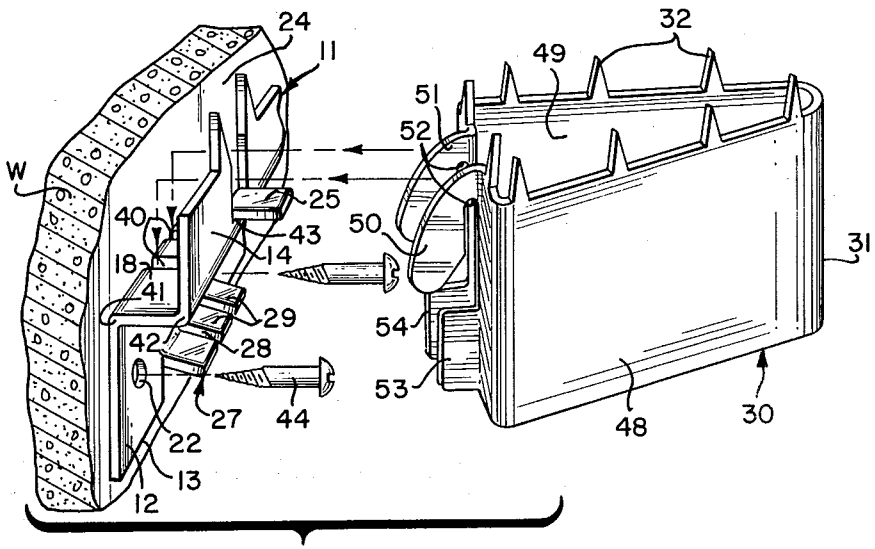
FIG. 3 is a perspective, sectional, exploded view showing the primary components of the bracket assembly prior to installation against a wall.

Referring primarily to FIG. 3, the intermediate strip 18 of holding bar 11 is formed with sets of retention slots 40. The retention slots 40 are aligned perpendicular to the holding bar corners 41 and 42.

The upper strip 14 is generally parallel to and offset both outwardly and forwardly from the lower strip 12. Immediately beneath the forwardly extending tab 25 is a stop wall 43 which aids in seating the hanger unit 30. The stop wall 43 is defined by a section of the holding bar upper strip 14.

The hanger unit 30 shown for purposes of illustration has a pair of side walls 48 and 49 whose outermost ends are joined with the front wall 31. Hanger unit 30 is formed with a pair of depending support hooks 50 and 51. The generally lower rearward portions of the side walls 48 and 49 form a pair of shoulders 53 and 54 that are shaped and sized to engage the lower strip 12 when the components are fully interfitted.

The support hooks 50 and 51 define a pair of locking slits 52 sized to slip over and interlock with the stop wall 43. The lower segments of support hooks 50 and 51 are oblong or rounded to facilitate slipping into their corresponding retention slots 40.

When the support hooks 50 and 51 are slipped into the retention slots 40 the shoulders 53 and 54 become inserted into corresponding gaps 28 and are prevented from lateral movement by the stabilizing tongues 29. Recess 24 is aligned vertically relative to the stabilizing means 27.

A broad variety of hanger units, differing in general configuration, width and depth, may be used in conjunction with the holding bar 11. Each such hanger unit must have a pair of locking arms or shoulders 53 and 54 shaped to interfit with the stabilizing means 27.

The shoulders may be close together to fit in the same stabilizing means as shown in the drawings and in my U.S. Design Pat. Nos. D240,196 and D240,197 granted June 8, 1976. Alternatively, the shoulders may be considerably spread apart to fit into different stabilizing means as shown in my U.S. Design Pat. Nos. D240,193 and D240,195 granted June 8, 1976. In the latter situation, one arm would fit in a gap of one stabilizing means while the other arm would fit into a gap of another stabilizing means. The tendencies to wobble and become misoriented thereby become greatly reduced.

Figure 4:
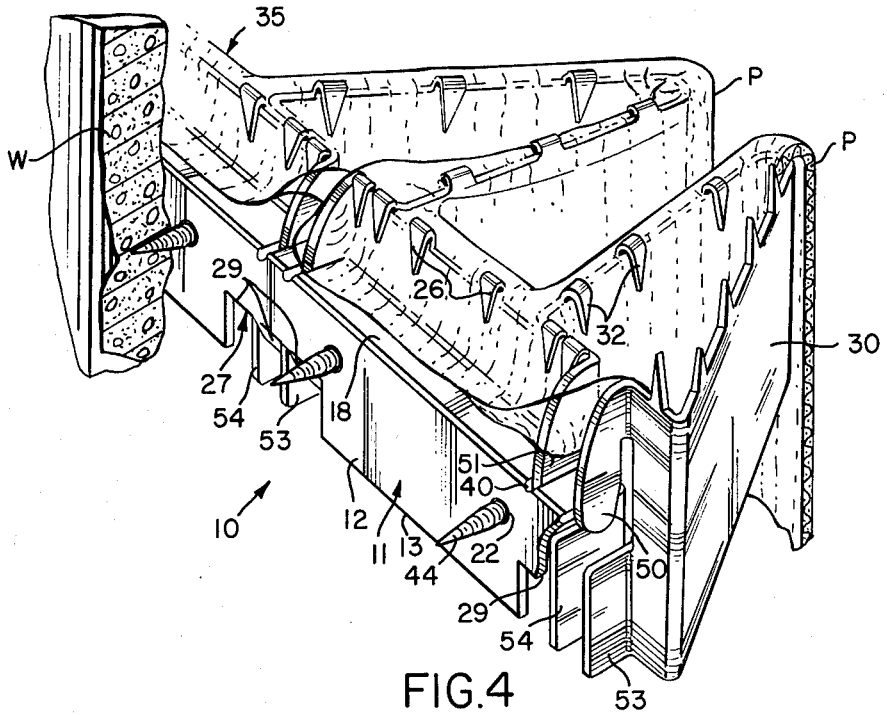
FIG. 4 is generally a rear, perspective view showing a bracket fully assembled and installed against a wall to hold fabric formed with pleats.

Referring now primarily to FIG. 4 the bracket 10 is shown mounted to the wall W of a large room by way of fasteners 44 extending through the fastener holes 22. A sheet of fabric 35, which may be burlap or any other relatively inexpensive material for example, is drawn over and attached to portions of the bracket 10 to constitute pleats P. The fabric margin is pulled over and pierced by the prongs 26 and spikes 32 which are then folded over to pinch or otherwise hold the fabric against the adjacent metal hardware. The support hooks 50 and 51 are slipped into corresponding retention slots 40 and the hanger unit shoulders 53 and 54 are slipped between adjacent tongues 29 of the stabilizer means 27. Excess marginal material of the fabric 35 may be bunched up and stuffed into the channel shaped space concealed by the holding bar 11 and hollow spaces defined by the hanger units 30.

Figure 5:
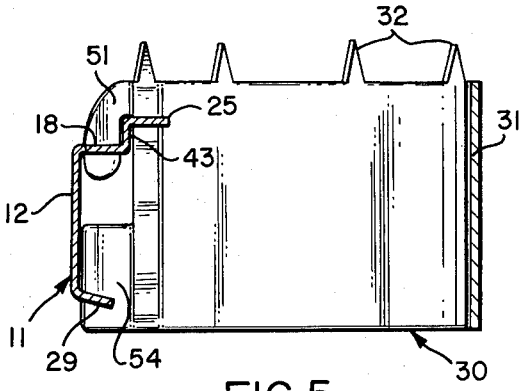
FIG. 5 is a side elevational and cross sectional view taken along lines 5—5 of FIG. 2; and, FIG. 6 is a perspective view showing the general orientation of an upper bracket and a parallel lower bracket arranged to mount and hold a fabric therebetween in a desired pleating pattern.

FIG. 5 shows a hanger unit 30 coupled in interfitting relationship with a section of the holding bar 11. The holding bar 11 and hanger units 30 are constructed from durable resilient material such as spring steel. The side walls and shoulders of the particular hanger units 30 shown for purposes of illustration are normally spread apart so that when ultimately installed they will exert a biasing force within the retention slots 40 and against the tongues 29 to augment the interlocking fit.

Figure 6:
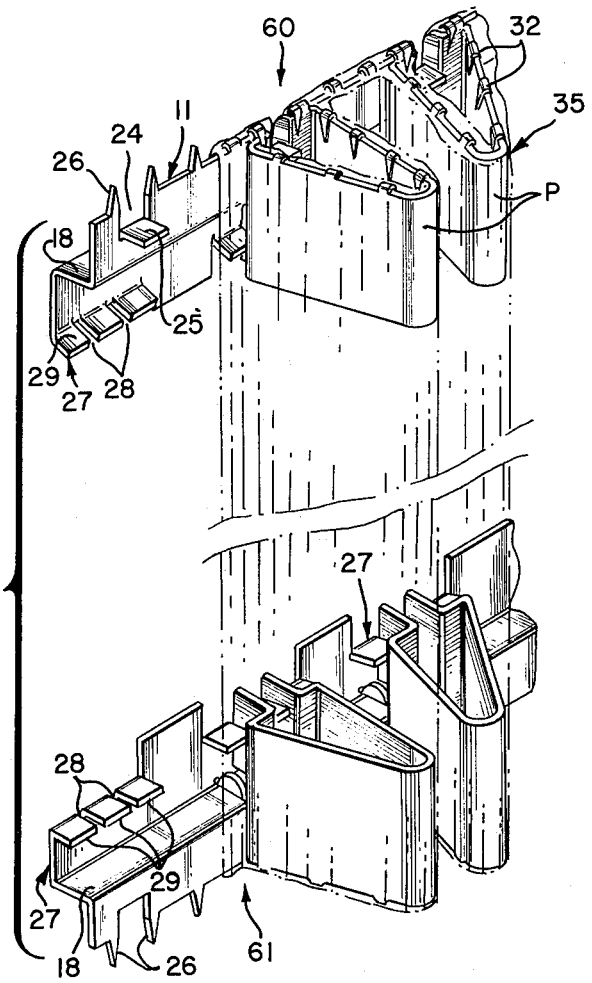

FIG. 6 shows an upper fabric hanging and pleating bracket 60 and a lower fabric hanging and pleating bracket 61 which are identical in construction with the bracket 10 shown in FIGS. 1 and 4.

OPERATION

Keeping the foregoing described construction of the invention in mind, the benefits, advantages and improved features can be better understood.

The fabric hanging and pleating bracket is versatile and can be used to create a broad variety of pleating patterns by varying the numbers, configurations and spatial relationships of particular hanger units.

Assuming that the decorator or installation person plans to install a fully pleated wall covering, then with reference to FIG. 6, the upper fabric hanging and pleating bracket 60 and lower fabric hanging and pleating bracket 61 are arranged in place and vertically aligned so that the resulting pleats will be vertical rather than oblique or crooked.

The individual hanger units 30 are resiliently clipped or snapped into place by inserting the support hooks 50 and 51 into corresponding retention slots 40 and slipping the hanger unit shoulders 53 and 54 between adjacent locking tongues 29 of the stabilizer means 27. The stabilizer means 27 prevents lateral movement tendencies of the hanger units 30 and maintain them generally steady as a workman positions the fabric 35 and fits it into place over the prongs 26 and spikes 32.

By way of illustration the upper margin of the fabric 35 is folded or doubled over to make an approximate two inch margin and is then sequentially drawn over the prongs 26 and spikes 32 from one side of the bracket 60 to the other. Thereafter the prongs 26 and spikes 32 are bent to better support and hold the fabric 35 in place.

Thereafter the lower margin of the fabric 35 is attached to the prongs 26 and spikes 32 of the lower bracket 61.

With the fabric 35 thus arranged in form-fitting relationship around consecutive hanger units 30 and drawn taut between the upper bracket 60 and the lower bracket 61, the fabric 35 between the brackets forms a series of attractive parallel pleats P.

From the foregoing it will be evident that the present invention has provided a fabric hanging and pleating bracket with stabilizing elements in which the various advantages have been realized.

I claim:

1. A fabric hanging and pleating bracket with sectional components, comprising:

a. an elongated holding bar including a lower strip with a bottom edge, an upper strip with a top edge offset outwardly and forwardly from the lower strip, and, an intermediate strip linking the lower strip and upper strip;

b. a plurality of prongs extending upwardly from the upper strip top edge for piercing and holding fabric;

c. at least one separable hanger unit removably coupled to and projecting forwardly from the holding bar, the hanger unit having a front wall shaped to assist in forming a fabric pleat and a pair of rearwardly extending shoulder;

d. spikes extending upwardly from a top edge of the hanger unit for piercing and supporting fabric;

e. a plurality of stabilizing means integrally formed at longitudinally spaced intervals with the holding bar — wherein each individual stabilizing means is a flange struck upwardly and forwardly from an edge section of the holding bar lower strip and is formed with a plurality of horizontally aligned parallel gaps defining at least three forwardly projecting tongues, and, at least one of the hanger unit shoulders is inserted into a gap and restrained from lateral movement by adjacent tongues, wherein when fabric is laid generally against the holding bar and hanger unit and drawn over the prongs and spikes, a section of the fabric will be formed into a pleat.

2. The structure according to claim 1, wherein:

the hanger unit shoulders are inserted into a pair of gaps.

3. The structure according to claim 1 wherein:

a recess is formed in the holding bar upper strip in vertical alignment with the stabilizing means;

the hanger unit is formed with a pair of support hooks, at least one of which is positioned in the recess; and, the holding bar intermediate strip is formed with retention slots sized and positioned to receive the support hooks.

4. The structure according to claim 3 including:

a plurality of hanger units coupled to the holding bar and spaced from one another; and, fabric arranged over the hanger units and holding bar to form a plurality of pleats.

5. The structure according to claim 4 including:

a second fabric hanging and pleating bracket with its holding bar and hanger units inverted relative to said holding bar and hanger units, the bracket being generally parallel and spaced from one another to hold opposite ends of the fabric therebetween in slightly stretched condition with a plurality of formed pleats.

* * * * *